US007013881B2

(12) United States Patent
Metzelard

(10) Patent No.: US 7,013,881 B2
(45) Date of Patent: Mar. 21, 2006

(54) METHOD FOR CONTROLLING IGNITION PARAMETERS OF A SPARK PLUG FOR INTERNAL COMBUSTION ENGINE

(75) Inventor: Olivier Metzelard, Vic le Comte (FR)

(73) Assignees: Institut Francais du Petrole, Rueil Malmaison Cedex (FR); Societe Apojee, Clermont-Ferrand Cedex 1 (FR)

( * ) Notice: Subject to any disclaimer, the term of this patent is extended or adjusted under 35 U.S.C. 154(b) by 177 days.

(21) Appl. No.: 10/484,775

(22) PCT Filed: Jul. 19, 2002

(86) PCT No.: PCT/FR02/02604

§ 371 (c)(1),
(2), (4) Date: Jan. 23, 2004

(87) PCT Pub. No.: WO03/010434

PCT Pub. Date: Feb. 6, 2003

(65) Prior Publication Data

US 2004/0237950 A1 Dec. 2, 2004

(30) Foreign Application Priority Data

Jul. 25, 2001 (FR) ..... 01 09974

(51) Int. Cl.
*F02P 1/00* (2006.01)

(52) U.S. Cl. ..... 123/594; 123/625

(58) Field of Classification Search ..... 123/594, 123/596, 597, 605, 606, 621, 625
See application file for complete search history.

(56) References Cited

U.S. PATENT DOCUMENTS 4,776,311 A * 10/1988 Venieres et al. ..... 123/335
5,179,928 A * 1/1993 Cour et al. ..... 123/606
6,138,653 A 10/2000 Juffinger
6,883,508 B1 * 4/2005 Geoffroy ..... 123/644

(Continued)

FOREIGN PATENT DOCUMENTS

EP 1101933 5/2001

OTHER PUBLICATIONS

Capacitor Discharge Ignition System Having Extended Burn Time, Kenneth Mason Publications, Hampshire, GB No. 333 1992, p. 23.

(Continued)

*Primary Examiner*—Bibhu Mohanty
(74) *Attorney, Agent, or Firm*—Antonelli, Terry, Stout and Kraus, LLP.

Capacitor Discharge Ignition System Having Extended Burn Time, Kenneth Mason Publications, Hampshire, GB No. 339, Jul. 1992 p. 579.
Capacitor Discharge Ignition System Having Extended Burn Time, Kenneth Mason Publications, Hampshire, GB No. 339, Jul. 1992 p. 577.

* cited by examiner

(57) ABSTRACT

The invention is a method for controlling ignition parameters of a spark plug (16) for an internal-combustion engine whose ignition is controlled by an engine control calculator, with the spark plug receiving a high voltage (U_HT) and a current (I_HT) from an ignition emulator (E). The method establishes a target current and/or voltage values (Ucible_HT, Ucible_Boost, Icible_HT, Icible_Boost) to obtain the desired electric arc at the spark plug electrodes, stores the target values in a parametering unit (32), measuring at regular intervals, after an ignition command by the calculator, at least one of a voltage (U_HT, U_Boost, U_Batt) and current (I_HT, I_Boost) parameter coming from the emulator, comparing the parameters with the target values, and when variation occur between the measured parameters and the target values, adjusting the parameters to reach the target values for controlling the ignition parameters of a spark plug for an internal-combustion engine. The spark plug receives a voltage (U_HT) and a current (I_HT) from ignition emulator (E). At least one interruption means (K1, K2, K3) control the voltage applied to the spark plug.

42 Claims, 2 Drawing Sheets

METHOD FOR CONTROLLING IGNITION PARAMETERS OF A SPARK PLUG FOR INTERNAL COMBUSTION ENGINE

BACKGROUND OF THE INVENTION

1. Field of the Invention

The present invention relates to a method for controlling ignition parameters of a spark plug for an internal-combustion engine and to an ignition device using such a method.

2. Description of the Prior Art

It is already well-known to use ignition coils to generate a high voltage applied to a spark plug in an engine. The high voltage applied to the spark plug creates, at the electrodes thereof, an electric arc whose energy is used to ignite an air/fuel mixture present in the combustion chamber of the engine.

These ignition coils generally consist of a primary winding, referred to as a primary, connected to a source of direct current, such as the battery of a motor vehicle, and a secondary winding, referred to as a secondary, connected to a spark plug and which, under the effect of the voltage applied to the primary, generates a high voltage which is applied to the spark plug so as to form, at the electrodes thereof, an electric arc or spark that ignites the air/fuel mixture.

This ignition, whose triggering time is determined by a calculator, referred to as engine calculator, usually part of an engine, is thus dependent on the arc quality, that is mainly on arc duration and on the electric parameters, such as the current intensity, the voltage. The ignition coils which are currently used in engines have been subjected to many tests to determine empirically their parameters so as to act as efficiently as possible on the spark plugs regarding the voltage applied to the secondary and the duration and current of the arc.

The primary voltage is therefore varied in order to simultaneously vary the secondary voltage until the ideal working point is obtained for the coil.

The drawbacks thus entailed are not insignificant insofar as the maximum capacities of the coils are readily reached because the primary of these coils is rapidly saturated with primary current.

Furthermore, in difficult contexts (lean mixture, high rate of recirculated gas, . . . ) leading to a poor ignition quality of the air/fuel mixture or even to the absence of ignition, it is impossible to determine which parameter (voltage, duration or intensity of the arc, . . . ) could be concerned, which consequently leads to use coils with maximum capacities in all the domains, thus increasing its cost price.

An article entitled "Capacitor Discharge Ignition System", published in July 1992 under reference No. RD 33975, describes an ignition device comprising an ignition coil whose primary is supplied by a voltage-carrying capacitor and a secondary connected to a spark plug.

The primary of this coil is furthermore connected in series to a field-effect transistor acting as an interruptor whose opening and closing phases are controlled by a command.

Thus, when the command actuates the field effect transistor (switch) in a closed position, the capacitor is discharged in the primary, creating a voltage in the secondary in order to supply under high voltage the spark plug and to generate the arc or the spark at the electrodes thereof.

After a short primary supply time, the command actuates the switch in open position for a short time, which interrupts supply of the primary and leads to a progressive current drop thereof. Then this switch is closed before the current in the primary and in the secondary is zero. These switch opening and closing commands are carried out repetitively to obtain an electric arc whose intensity decreases with time.

This layout allows configuring the parameters of this ignition device (duration of the electric arc at the spark plug electrodes, voltage applicable to the secondary) only for a single type of use.

If it is desired to modify these parameters for another type of coil, it is necessary to establish another type of command for closing and opening of the switch, or even to modify the primary and the secondary of the new coil.

Furthermore, as in the case of conventional ignition coils, it is impossible to monitor the working parameters of this ignition, such as the secondary voltage or the duration of the arc or its intensity, to be able to correct them in a case of a deviation in relation to reference values.

SUMMARY OF THE INVENTION

The present invention overcomes the aforementioned drawbacks by providing an ignition device that replaces the ignition coil and allows easy control of all the parameters relative to the electric arc of the spark plug.

A method is therefore provided for controlling ignition parameters of a spark plug for an internal-combustion engine whose ignition is controlled by an engine control calculator, said spark plug receiving a high voltage and a current from an ignition emulator, said method establishing target current and/or voltage values to obtain the desired electric arc at the spark plug electrodes, storing the target values in a parametering unit, measuring at regular intervals, after an ignition command by the calculator, at least one voltage parameter and/or a current parameter coming from the emulator, comparing the parameters with the target values, and in the case of variation between the measured parameters and the target values, adjusting the parameters to reach the target values, by acting on at least one interruption means switching device to control the voltage applied to the spark plug.

Preferably, it is possible to act on at least one interruption means to control the voltage rise applied to the spark plug.

It is also possible to act on at least one interruption means to control the voltage drop applied to the spark plug.

It is also possible to act on at least one interruption means of a voltage converter to adjust the high voltage received by the spark plug.

The invention also relates to an ignition emulation device for internal-combustion engine comprising a spark plug associated with a combustion chamber and supplied with high voltage by an ignition emulator for implementing the method, wherein the ignition emulator comprises a current converter associated with an interruption means and a chopper associated with an upper interruption means and a lower interruption means, and in that the device comprises a parametering unit and a control associated with the ignition emulator, the parametering unit containing at least one of the target current and voltage values allowing obtaining of a desired electric arc at the spark plugelectrode, and the control receives at least one of measured voltage and a current parameter from the emulator and compares at least one parameter with the target values so as to adjust, when variation between the measured at least one parameter and the target values occurs, the parameters controlling the interruption means switching device in order to reach the target values.

The control box can comprise inputs for at least one voltage and current signals from the emulator.

Advantageously, the control can comprise at least one input for at least one of target voltage and current value to be applied to the spark plug.

The control can comprise at least one output for control signals applied to the interruption means of the emulator.

The invention provides variable parameters allowing configuration of the same device for several types of use and to obtain all the information required on adequacy of the arc produced by the spark plug.

BRIEF DESCRIPTION OF THE FIGURES

Other features and advantages of the invention will be clear from reading the description hereafter, given by way of non limitative example, with reference to the accompanying figures wherein.

DETAILED DESCRIPTION

Figure 1:
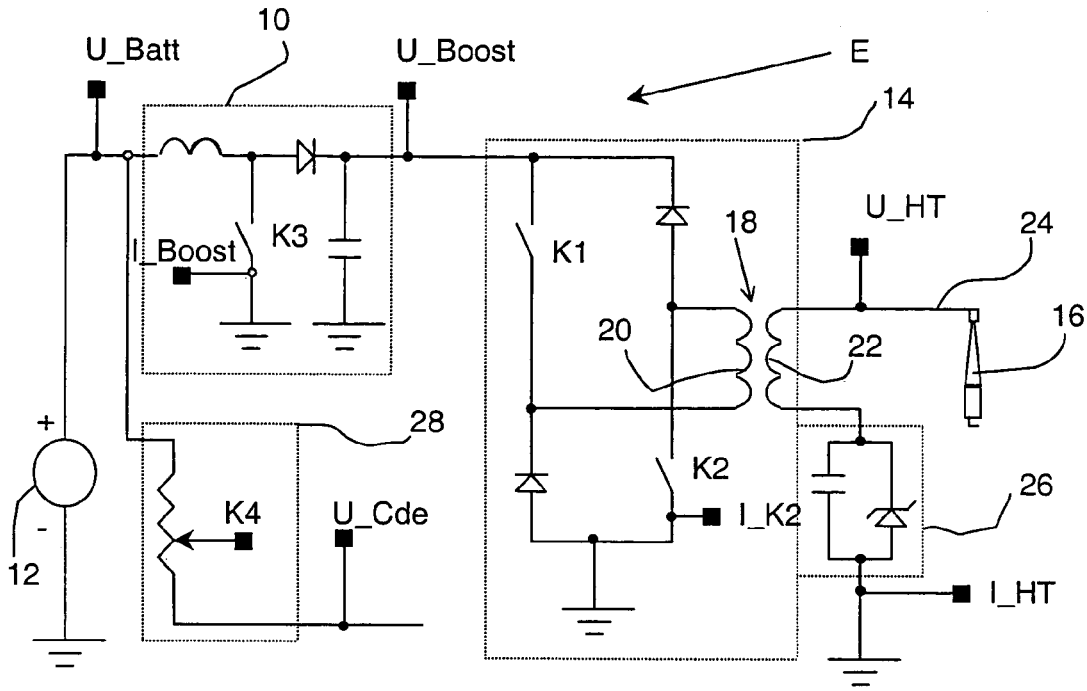
FIG. 1 diagrammatically shows an ignition emulator applicable for the method and the device according to the invention, FIG. 2 diagrammatically shows a control of an ignition emulator according to FIG. 1.

FIG. 1 shows an ignition emulator E for internal-combustion engine, notably of a motor vehicle, comprising a voltage converter 10 which converts the voltage coming from a battery 12 up to a voltage of 600 V, which is preferably up to 400 V, and a chopper 14 for generating a high voltage on a spark plug 16. The high voltage generates an electric arc or spark at the electrodes of this spark plug, thus allowing ignition of an air/fuel mixture present in a combustion chamber of an internal-combustion engine.

As can be clearly seen in FIG. 1, converter 10 comprises an interrupter switch K3 switching device allowing varying the voltage at the output thereof until the desired voltage to be applied to chopper 14 is reached.

Chopper 14, whose input is connected to the output of converter 10, comprises a transformer 18 equivalent to an ignition coil with a primary 20 and a secondary 22.

Primary 20 comprises two interrupter switches, an upper interrupter switch K1 allowing control of the current rise in the primary, and an upper interruptor switch K2 for the current drop in this primary.

Secondary 22 is conventionally connected to spark plug 16 by an electric conductor 24.

Figure 2:
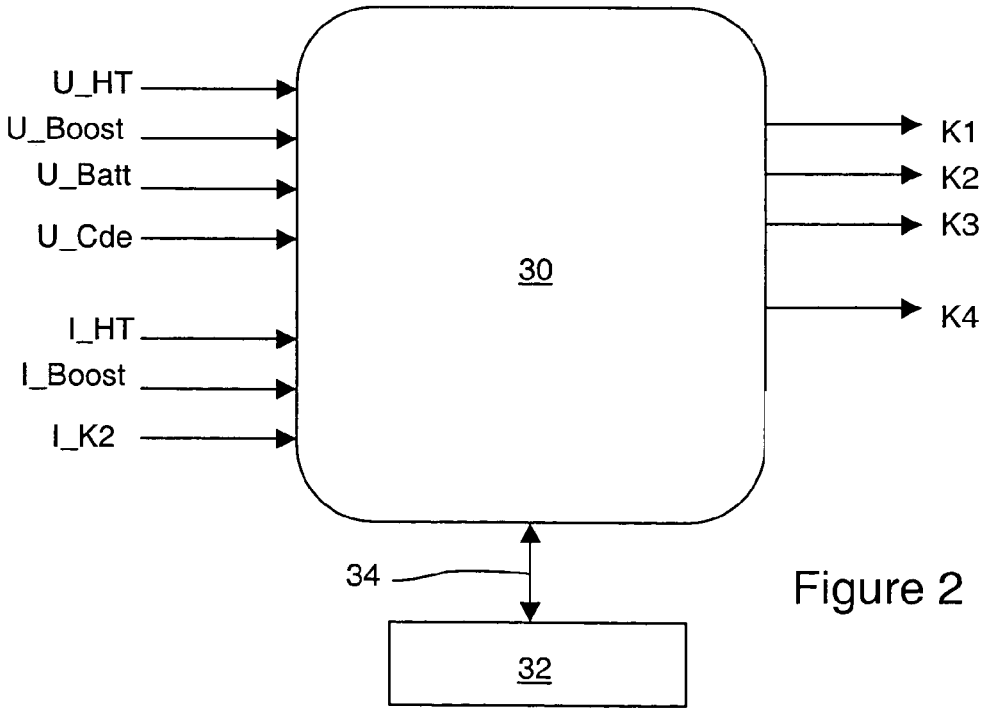

The emulator is connected to a control 30 (see FIG. 2) which receives measuring input signals from emulator E, target value signals from a parametering unit 32 through a channel 34, and which emits output signals controlling interruptor switches K1 and/or K2 and/or K3 and/or resistance K4 of emulator E.

Parametering unit 32 contains all the theoretical target values allowing obtaining the desired electric arc at the spark plug for a determined period of time.

These values are notably the voltage (Ucible_HT) and the intensity of the current (Icible_HT) at the output of chopper 14, the voltage (Ucible_Boost) and the intensity of the current (Icible_Boost) at the output of converter 10. These target values thus allow determining the maximum secondary voltage (Us max), the time (Tmax US) when this maximum voltage is to be reached and the voltage (Uarc) for maintaining the electric arc at the spark plug electrodes for a determined time (Ts).

Figure 3:
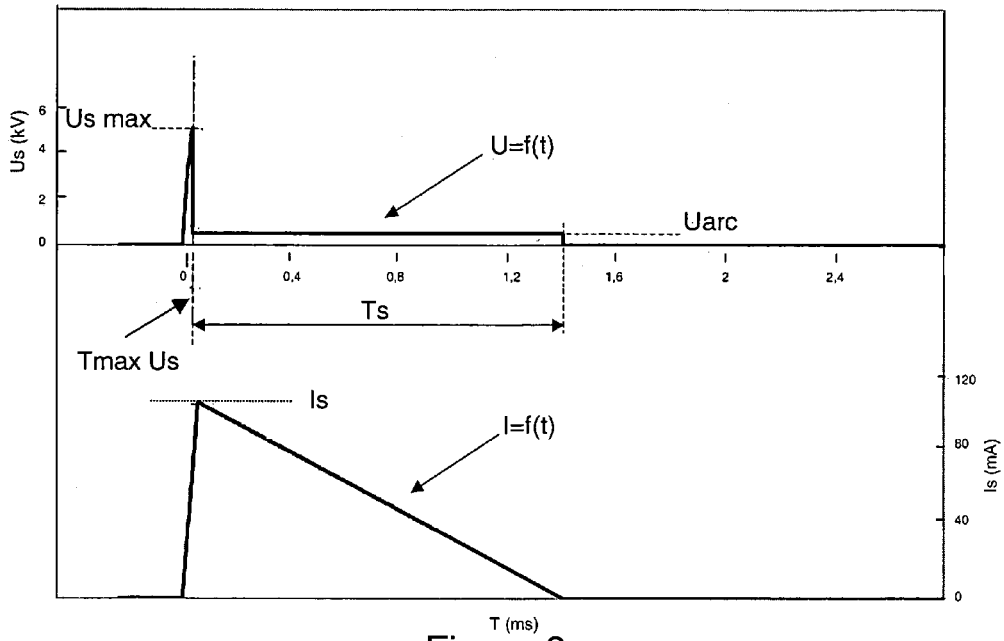
FIG. 3 shows the theoretical curves of the voltage and intensity to be applied to the spark plug of the ignition device.

A theoretical curve has been defined according to these values, as shown in FIG. 3, for the voltage U=f(t) to be applied to the secondary to obtain the desired electric arc at the spark plug electrodes.

According to this curve, after ignition has been commanded by the engine calculator, secondary 22 of transformer 18 is supplied with voltage by primary 20, in a substantially increasing linear way, up to the maximum voltage Us max and for a determined time Tmax Us during which the arc forms at the spark plug electrodes. Upon creation of the arc, the secondary voltage drops suddenly and reaches a determined voltage value Uarc which is maintained for a certain time interval Ts to sustain the electric arc. At the end of the time Ts, the secondary is no longer supplied with voltage and it reaches a zero value for extinction of the arc.

This theoretical secondary supply curve allows obtaining a theoretical waveshape I=f(t) of the current intensity as a function of time applied to secondary 22 and, consequently, to the spark plug electrodes, and it comprises a current intensity maximum Is of the effective realization of the arc.

By means of this layout, unit 32 can contain values allowing simulating any coil types with capacities up to a secondary voltage of 50 kV within a time ranging from 10 $\mu$s to 500 $\mu$s, a duration of the arc at the spark plug electrodes from 10 $\mu$s (microseconds) to 10 ms (milliseconds) and a current intensity applied to the secondary up to 1 A.

The theoretical values selected are transmitted, through channel 34, to control 30 which also receives the input signals measuring the real voltages for the battery (U_Batt), the converter output (U_Boost) and the chopper output (U_HT), as well as input signals corresponding to the measurement of the real currents at interruptor switch K3 of the converter (I_Boost), at lower interruptor switch K2 of the chopper (I_K2) and at the chopper output (I_HT).

Parametering unit 32 can also contain other values such as the number of arcs in case of multispark ignition and the time between two arcs.

Figure 4:
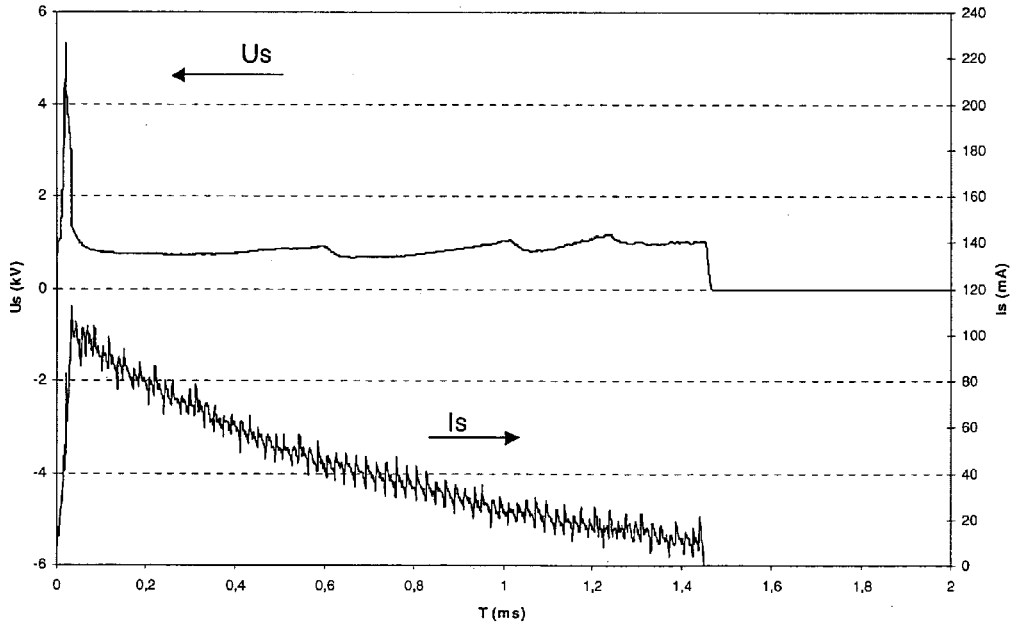
FIG. 4 shows the real curves of the voltage and intensity applied to the spark plug.

In practice, as can be seen in FIG. 4, the ignition device according to the invention allows obtaining, in the upper part, the curve of voltage as a function of time measured at the secondary and, in the lower part, the curve of current intensity as a function of time read at the secondary.

It can be seen in these curves that the ignition device allows adjusting all the parameters required for the voltage curve to correspond to that of the theoretical curve of FIG. 3 so that the intensity curve has a general shape close to that of the theoretical curve.

To reach this result, the following procedure is followed:

- the target voltage and/or current values allowing obtaining of a desired waveshape at the secondary 22 and consequently at the spark plug electrodes are stored in parametering unit 32,
- control 30 receives, through channel 32, the target voltage and/or current values,
- the voltage (U_HT, U_Boost, . . . ) and/or intensity (I_HT, I_Boost, . . . ) parameters coming from the emulator are measured after the ignition instruction given by the calculator,
- the target values are compared with the real voltage and/or current measured values,
- in case of variation between the signals received and the target values, control box 30 sends output signals to control one or more interrupter switches K1, K2, and K3, and variable resistance K4 so that these target values are reached.

Preferably, to allow good monitoring of the ignition parameters, the voltage and/or current values are measured every microsecond as soon as the ignition control of the engine calculator is cut off, that is after the ignition instruction has been given by the calculator and before the electric arc forms at the spark plug electrodes.

In practice, if a difference is detected by the control, it controls interruptor switch K3 so as to increase or decrease the voltage at the input of chopper 14, which leads to an increase or to a decrease in the voltage of primary 20 and, consequently, an increase or a decrease in the high voltage at secondary 22.

The box can also, by means of the controls actuating interruptor switches K1 and K2, control the current rise in primary 20 by means of interruptor switch K1 and/or the current drop by means of interruptor switch K2, which has the effect of controlling the rise and the drop of the high voltage applied to spark plug 16.

Of course, without departing from the scope of the invention, interruptor switches K1, K2 or K3 or variable resistance K4 can be controlled separately or together, or in combination.

Thus, by means of this layout, it is possible to constantly manage the parameters of the arc at the spark plug electrodes and more particularly the energy of the arc, its duration, the number of arcs during a determined time interval and the time between two arcs in case of multispark ignition, while controlling the voltage and the current of the secondary.

Furthermore, it is also possible to manage the maximum voltage of secondary 22 and the time required to reach this maximum voltage.

The present invention is not limited to the examples described above and it includes all variants.

Emulator E can notably comprise an ionization module 26 allowing knowledge if combustion has occurred in the chamber of the engine and thus to determine that the ignition parameters are properly established for this combustion.

Furthermore, emulator E can also comprise a voltage source 28, variable by means of interruptor resistance K4, which allows sending to the calculator typically found in an engine generally equipped with a current similar to the current of an ignition coil allowing preventing any defect in said calculator, this current being measured by box 30 through channel U_Cde.

Of course, the invention described above can also be applied to an internal-combustion engine simulation bench.

In this case, the parametering unit is replaced by any means such as a PC computer type calculator, which allows direct parameterization of ignition devices with various waveshapes that can be generated by the secondary.

The invention claimed is:

1. A method for controlling ignition parameters of a spark plug for an internal-combustion engine including ignition controlled by an engine control calculator, the spark plug receiving a high voltage and a current from an ignition emulator, the method comprising:

establishing at least one of target current and voltage values to obtain a desired electric arc at a spark plug electrode, storing the target values in a parametering unit, measuring at intervals, after an ignition command by the calculator, at least one of a voltage and current parameter coming from the emulator, comparing the at least one parameter with the target values, and when variation occurs between at least one measured parameter and the target values, adjusting the at least one parameter to reach the target values, and wherein at least one switching device controls the voltage applied to the spark plug.

2. A method as claimed in claim 1, wherein:

the at least one switching device controls a voltage rise applied to the spark plug.

3. A method as claimed in claim 1, wherein:

the at least one switching device controls a voltage drop applied to the spark plug.

4. A method as claimed in claim 2, wherein:

the at least one switching device controls a voltage drop applied to the spark plug.

5. A method as claimed in claim 1, wherein:

a switching device of a voltage converter adjusts the high voltage received by the spark plug.

6. A method as claimed in claim 2, wherein:

a switching device of a voltage converter adjusts the high voltage received by the spark plug.

7. A method as claimed in claim 3, wherein:

a switching device of a voltage converter adjusts the high voltage received by the spark plug.

8. A method as claimed in claim 4, wherein:

a switching device of a voltage converter adjusts the high voltage received by the spark plug.

9. An ignition emulation device for an internal-combustion engine comprising a spark plug associated with a combustion chamber and supplied with a high voltage by an ignition emulator for implementing the method as claimed in claim 1, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

10. An ignition emulation device for an internal-combustion engine comprising a spark plug associated with a combustion chamber and supplied with a high voltage by an ignition emulator for implementing the method as claimed in claim 2, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

11. An ignition emulation device for an internal-combustion engine comprising a spark plug associated with a combustion chamber and supplied with a high voltage by an ignition emulator for implementing the method as claimed in claim 3, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

12. An ignition emulation device for an internal-combustion engine comprising a spark plug associated with a combustion chamber and supplied with a high voltage by an ignition emulator for implementing the method as claimed in claim 4, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

13. An ignition emulation device for an internal-combustion engine comprising a spark plug associated with a combustion chamber and supplied with a high voltage by an ignition emulator for implementing the method as claimed in claim 5, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

14. An ignition emulation device for an internal-combustion engine comprising a spark plug associated with a combustion chamber and supplied with a high voltage by an ignition emulator for implementing the method as claimed in claim 6, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

15. An ignition emulation device for an internal-combustion engine comprising a spark plug associated with a combustion chamber and supplied with a high voltage by an ignition emulator for implementing the method as claimed in claim 7, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

16. An ignition emulation device for an internal-combustion engine comprising a spark plug associated with a combustion chamber and supplied with a high voltage by an ignition emulator for implementing the method as claimed in claim 8, wherein:

the ignition emulator comprises a current converter associated with the at least one switching device and a chopper associated with a first switching device and with a second switching device, and the ignition emulation device comprises the parametering unit and a control associated with the ignition emulator, the parametering unit storing at least one target current and voltage values allowing obtaining a desired electric arc at the spark plug electrode, and the control receives the at least one of the measured voltage and current parameter from the emulator and compares the received at least one parameter with the target values so as to adjust, when variation occurs between the at least one measured parameter and the target values, the at least one parameter by controlling the at least one switching device in order to reach the target values.

17. A device as claimed in claim 9, wherein:

the control comprises inputs for voltage and current signals coming from the ignition emulator.

18. A device as claimed in claim 10, wherein:

the control comprises inputs for voltage and current signals coming from the ignition emulator.

19. A device as claimed in claim 11, wherein:
the control comprises inputs for voltage and current signals coming from the ignition emulator.

20. A device as claimed in claim 12, wherein:
the control comprises inputs for voltage and current signals coming from the ignition emulator.

21. A device as claimed in claim 13, wherein:
the control comprises inputs for voltage and current signals coming from the ignition emulator.

22. A device as claimed in claim 14, wherein:
the control comprises inputs for voltage and current signals coming from the ignition emulator.

23. A device as claimed in claim 15, wherein:
the control comprises inputs for voltage and current signals coming from the ignition emulator.

24. A device as claimed in claim 16, wherein:
the control comprises inputs for voltage and current signals coming from the ignition emulator.

25. A device as claimed in claim 9, wherein:
the control comprises at least one input for at least one of a target voltage and a current value to be applied to the spark plug.

26. A device as claimed in claim 10, wherein:
the control comprises at least one input for at least one of a target voltage and a current value to be applied to the spark plug.

27. A device as claimed in claim 11, wherein:
the control comprises at least one input for at least one of a target voltage and a current value to be applied to the spark plug.

28. A device as claimed in claim 12, wherein:
the control comprises at least one input for at least one of a target voltage and a current value to be applied to the spark plug.

29. A device as claimed in claim 13, wherein:
the control comprises at least one input for at least one of a target voltage and a current value to be applied to the spark plug.

30. A device as claimed in claim 14, wherein:
the control comprises at least one input for at least one of a target voltage and a current value to be applied to the spark plug.

31. A device as claimed in claim 15, wherein:
the control comprises at least one input for at least one of a target voltage and a current value to be applied to the spark plug.

32. A device as claimed in claim 16, wherein:
the control comprises at least one input for at least one of a target voltage and a current value to be applied to the spark plug.

33. A device as claimed in claim 17, wherein:
the control comprises at least one input for at least one of a target voltage and a current value to be applied to the spark plug.

34. A device as claimed in claim 18, wherein:
the control comprises at least one input for at least one of a target voltage and a current value to be applied to the spark plug.

35. A device as claimed in claim 19, wherein:
the control comprises at least one input for at least one of a target voltage and a current value to be applied to the spark plug.

36. A device as claimed in claim 20, wherein:
the control comprises at least one input for at least one of a target voltage and a current value to be applied to the spark plug.

37. A device as claimed in claim 21, wherein:
the control comprises at least one input for at least one of a target voltage and a current value to be applied to the spark plug.

38. A device as claimed in claim 22, wherein:
the control comprises at least one input for at least one of a target voltage and a current value to be applied to the spark plug.

39. A device as claimed in claim 23, wherein:
the control comprises at least one input for at least one of a target voltage and a current value to be applied to the spark plug.

40. A device as claimed in claim 9, wherein the control comprises at least one output for control signals for connection to the at least one switching device of the emulator.

41. A device as claimed in claim 17, wherein the control comprises at least one output for control signals for connection to the at least one switching device of the emulator.

42. A device as claimed in claim 25, wherein:
the control comprises at least one input for at least one of a target voltage and a current value to be applied to the spark plug.

* * * * *